US010729942B2

(12) United States Patent
McGarvey

(10) Patent No.: US 10,729,942 B2
(45) Date of Patent: Aug. 4, 2020

(54) INFLATION NEEDLE

(71) Applicant: McGarvey Holdings, Inc., Columbia, MD (US)

(72) Inventor: Michael McGarvey, Columbia, MD (US)

(73) Assignee: MCGARVEY HOLDINGS, INC., Columbia, MD (US)

( * ) Notice: Subject to any disclaimer, the term of this patent is extended or adjusted under 35 U.S.C. 154(b) by 56 days.

(21) Appl. No.: 16/172,410

(22) Filed: Oct. 26, 2018

(65) Prior Publication Data

US 2019/0126105 A1 May 2, 2019

Related U.S. Application Data

(60) Provisional application No. 62/578,101, filed on Oct. 27, 2017.

(51) Int. Cl.

| | |
|---|---|
| ***A63B 41/12*** | (2006.01) |
| ***F04B 45/02*** | (2006.01) |
| ***F04B 45/06*** | (2006.01) |
| ***F04B 39/10*** | (2006.01) |
| ***F04B 33/00*** | (2006.01) |

(52) U.S. Cl.

CPC ..... *A63B 41/12* (2013.01); *F04B 33/00* (2013.01); *F04B 39/10* (2013.01); *F04B 45/02* (2013.01); *F04B 45/06* (2013.01)

(58) Field of Classification Search

CPC ..... A63B 41/12; A63B 2209/00; A63B 39/00; F04B 39/10; F04B 33/00; F04B 45/06; F04B 45/02; A61J 1/1406; A61J 1/2006; A61J 1/201; A61J 1/2027; F16K 15/202; B60C 23/10

USPC ..... 141/329

See application file for complete search history.

(56) References Cited

U.S. PATENT DOCUMENTS

| | | | | | |
|---|---|---|---|---|---|
| 3,951,573 | A * | 4/1976 | Dunning | F16C 17/04 | 417/423.13 |
| 4,043,356 | A * | 8/1977 | Morris | A63B 41/12 | 137/320 |
| 4,340,222 | A | 7/1982 | Kerkenbush et al. | | |
| 5,257,470 | A * | 11/1993 | Auger | A43B 23/029 | 36/114 |
| 5,556,258 | A * | 9/1996 | Lange | F04B 33/00 | 417/440 |
| 6,113,366 | A * | 9/2000 | Hobson | F04B 45/02 | 417/472 |
| 7,730,913 | B2 * | 6/2010 | Voorhies | A63B 41/12 | 137/231 |

(Continued)

FOREIGN PATENT DOCUMENTS

| | | | |
|---|---|---|---|
| CN | 2675193 | Y | 2/2005 |
| CN | 105538558 | A | 5/2016 |

*Primary Examiner* — Marina A Tietjen
*Assistant Examiner* — Stephanie A Shrieves
(74) *Attorney, Agent, or Firm* — Brake Hughes Bellermann LLP

(57) ABSTRACT

An inflation needle includes a first end for insertion into an inflatable object, a second end for connection to a pump and an elongated member having a conduit for air therethrough and connecting the first end and the second end, where at least a portion of the elongated member includes a flexible portion. The flexible portion may include a flexible bellows.

18 Claims, 4 Drawing Sheets

(56) References Cited

U.S. PATENT DOCUMENTS

| | | | | |
|---|---|---|---|---|
| 7,857,015 | B2 * | 12/2010 | Voorhies | A63B 41/12 137/231 |
| 8,402,986 | B1 * | 3/2013 | Gray | A47L 7/04 137/223 |
| 8,733,388 | B1 | 5/2014 | Gray | |
| D740,328 | S | 10/2015 | Maw | |
| 2009/0025825 | A1 * | 1/2009 | Voorhies | A63B 41/12 141/329 |
| 2015/0129084 | A1 * | 5/2015 | Maw | A63B 41/12 141/329 |

* cited by examiner

INFLATION NEEDLE

CROSS REFERENCE TO RELATED APPLICATION

This application claims priority to and the benefit of U.S. Provisional Application No. 62/578,101, filed Oct. 27, 2017, and titled "Inflation Needle," which is hereby incorporated by reference in its entirety.

TECHNICAL FIELD

This description relates to an inflation needle.

BACKGROUND

An inflation needle may be used to deliver air or other gases from an air source, such as a pump, to an inflatable object. The inflatable object may be a ball, a mattress, a toy or other type of inflatable object. Typically, the inflation needle is made of a solid, rigid material. The inflation needle is prone to breaking. Often the inflation needle breaks during inflation resulting in the inflation needle breaking off while inside the inflatable object including getting lost inside the inflatable object, all of which may result in damage to the inflatable object.

SUMMARY

According to one general aspect, an inflation needle includes a first end for insertion into an inflatable object, a second end for connection to a pump and an elongated member having a conduit for air therethrough. The elongated member connects the first end and the second end, where at least a portion of the elongated member includes a flexible portion.

Implementations may include one or more of the following features. For example, the flexible portion may include a flexible bellows. The flexible portion may include a flexible metal material. The flexible portion may include a flexible plastic material. The first end, the second end and the elongated member may include a metal material and/or a rubber material. The elongated member may further include a first rigid portion connecting the first end to the flexible portion and a second rigid portion connecting the flexible portion to the second end. The inflation needle may further include a stopping member that is oriented perpendicular to the elongated member to provide a stopping point for insertion into the inflatable object. The first end may be tapered for insertion into the inflatable object. The second end may include a threaded portion for connection to the pump. The inflation needle may be cast-molded as a single piece of material.

In another general aspect, an inflation needle includes a first end that is tapered for insertion into an inflatable object, a second end having a threaded connection for connection to a pump and an elongated member having a conduit for air therethrough. The elongated member connects the first end and the second end. The elongated member includes a first rigid portion adjacent the first end, a flexible portion, where the first rigid portion connects the first end to the flexible portion, and a second rigid portion that connects the flexible portion to the second end.

Implementations may include one or more of the following features. For example, the flexible portion may include a flexible bellows. The flexible portion may include a flexible metal material. The flexible portion may include a flexible plastic material. The first end, the second end and the elongated member may include a metal material and/or a rubber material. The inflation needle may further include a stopping member that is oriented perpendicular to the elongated member to provide a stopping point for insertion into the inflatable object. The stopping member may be disposed between the flexible portion and the first end. The inflation needle may be cast-molded as a single piece of material.

In another general aspect, an inflation needle includes a first end that is tapered for insertion into an inflatable object, a second end for connection to a pump, a rigid portion adjacent the first end and a flexible portion connecting the rigid portion and the second end, where the second end, the flexible portion, the rigid portion and the first end define a conduit for air therethrough.

Implementations may include one or more of the following features. For example, the flexible portion may include a flexible bellows. The flexible portion may include a flexible metal material. The flexible portion may include a flexible plastic material. The inflation needle may further include a stopping member that is oriented perpendicular to the rigid portion to provide a stopping point for insertion into the inflatable object. The stopping member may be disposed between the flexible portion and the first end. The first end may be tapered for insertion into the inflatable object. The second end may include a threaded portion for connection to the pump. The inflation needle may be cast-molded as a single piece of material.

The details of one or more implementations are set forth in the accompanying drawings and the description below. Other features will be apparent from the description and drawings, and from the claims.

DETAILED DESCRIPTION

This document describes an inflation needle that includes a flexible portion to reduce the occurrence of the inflation needle breaking, especially during inflation of an inflatable object. In some implementations, the flexible potion may be implemented as a flexible bellows. In some implementations, the flexible portion may be implemented as a flexible conduit that may connect to more rigid portions on other end of the flexible portion. The inflation needle with the flexible portion (e.g., flexible bellows), as described in more detail below, provides the inflation needle with some flexibility and give (or play) to allow the inflation needle to bend without breaking. The flexible portion (e.g., flexible bellows) provides a bend point on the inflation needle that allows for bending of the needle including when inserted into an inflatable object.

Figure 1A:
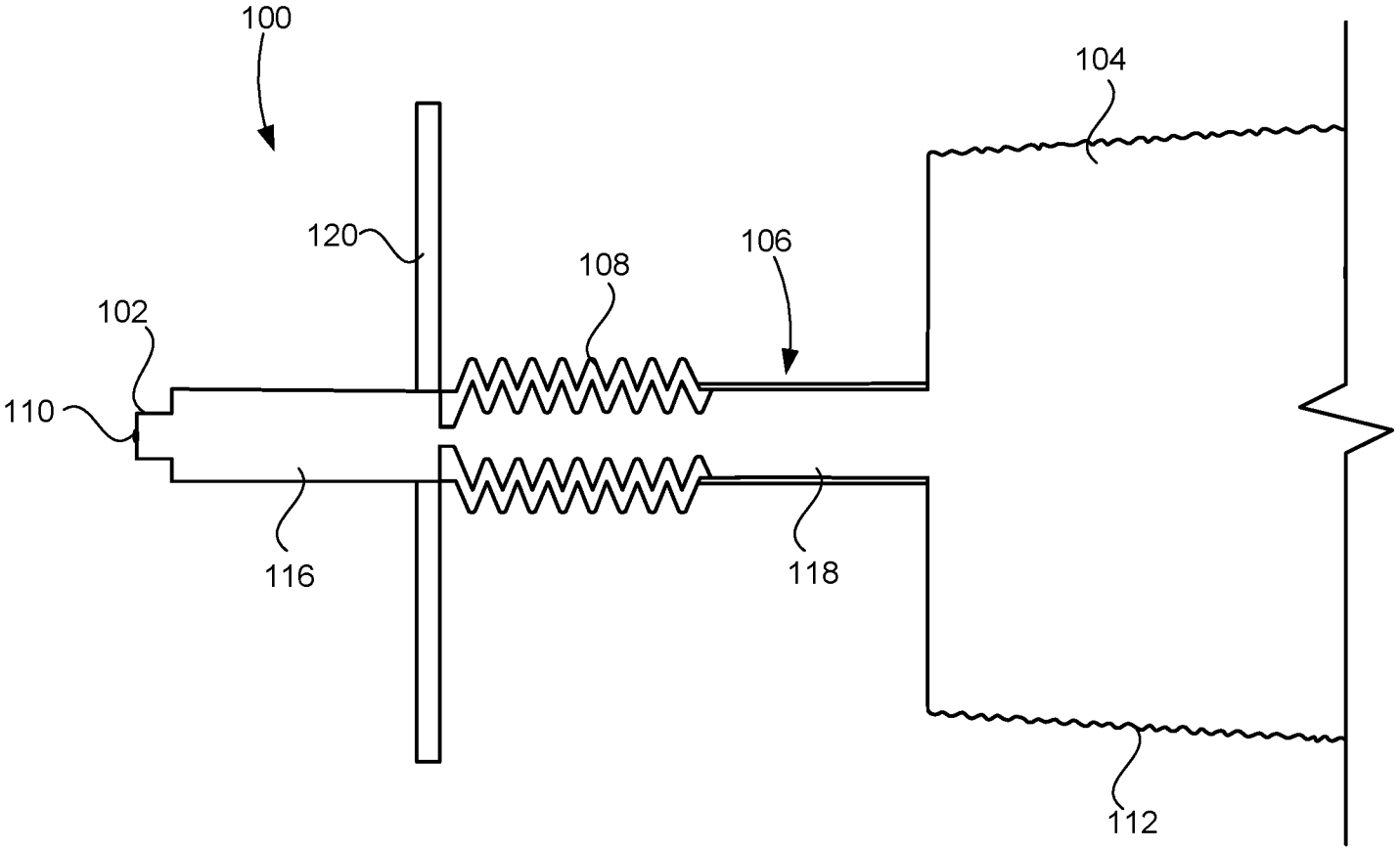
FIG. 1A is a side view of an inflation needle in accordance with a first embodiment.

Referring to FIG. 1A, a side view of an inflation needle 100 is illustrated. The inflation needle 100 connects to a pump and inserts into an inflatable object to deliver air or other gas from the pump to the inflatable object. The inflation needle 100 includes a first end 102 for insertion into the inflatable object, a second end 104 for connection to the pump and an elongated member 106 having a conduit for air and connecting the first end 102 and the second end 104. At least a portion of the elongated member 106 includes a flexible portion 108. In some implementations, the entire elongated member 106 includes the flexible portion 108, which may be implemented as a flexible bellows.

The first end 102 is tapered for insertion into the inflatable object. In some implementations, the first end 102 may taper into a rounded point for insertion into the inflatable object. The first end 102 includes an outlet 110 for the air from the pump to travel through the inflation needle 100 and to direct the air into the inflatable object. The outlet 110 is located at the tip of the first end 102. In some implementations, the outlet 110 may be located on a side of the first end 102. Also, the outlet 110 may include different sizes and/or shapes in order to direct the air from the inflation needle 102 to the inflatable object.

The second end 104 connects to a pump. The second end 104 may be sized to fit and cooperate with a standard air pump connection. The second end 104 may be wider than the other portions of the inflation needle 100. In some implementations, at least a portion of the second end 104 may include threads 112 around the external circumference of the second end 104. The threads 112 may allow for a pump to better grip and hold the second end 104 of the inflation needle 100. The threads 112 also may be used to screw the second end 104 into a pump having a threaded connection.

Figure 1B:
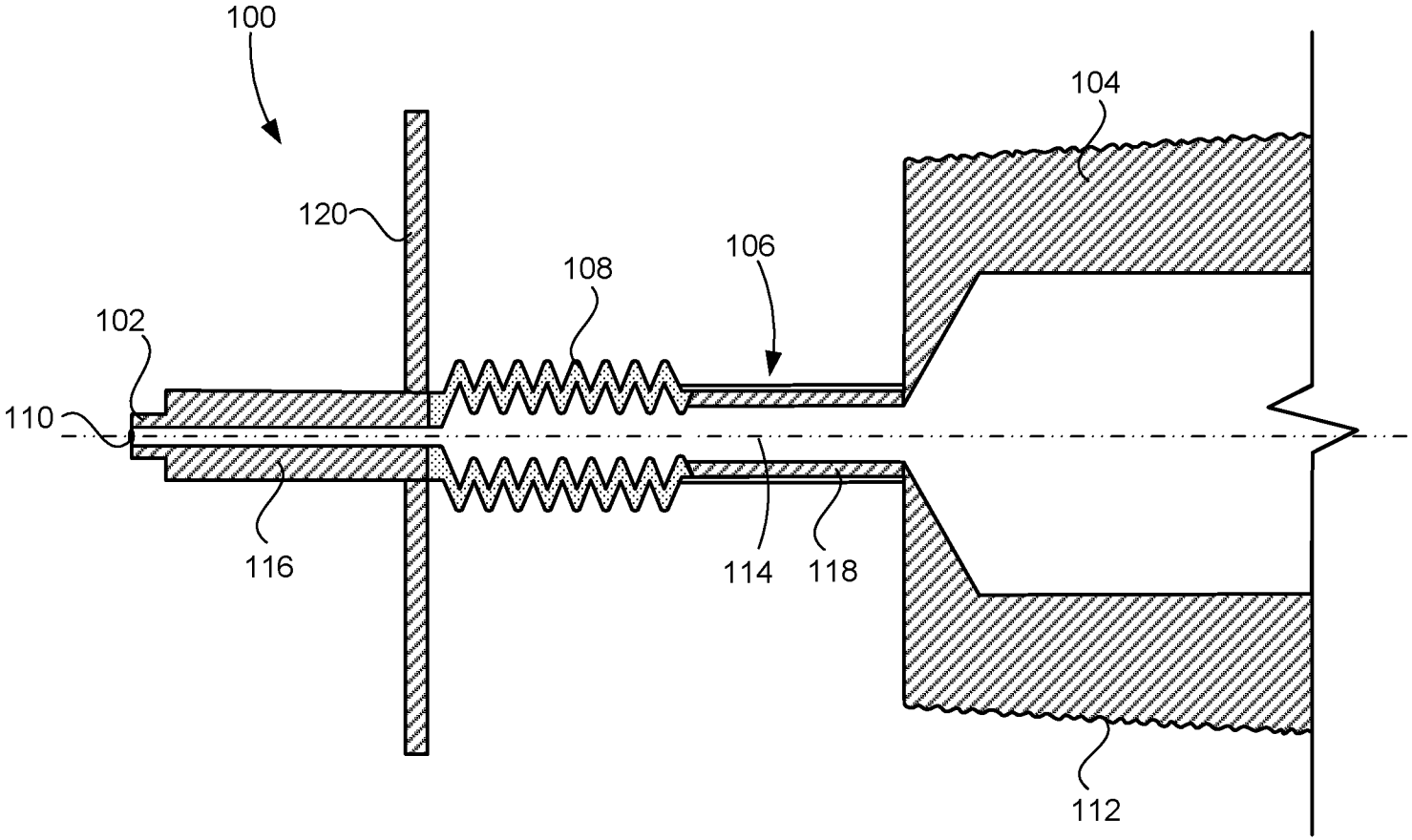
FIG. 1B is a cross section view of the inflation needle of FIG. 1A.

The elongated member 106 may have a generally cylindrical shape. In some implementations, other shapes and configurations are possible. The elongated member 106 also may be referred to interchangeably as a stem. The elongated member 106 is located between the first end 102 and the second end 104 and connects the first end 102 and the second end 104. Referring also to FIG. 1B, which illustrates a cross-section view of the inflation needle 100 of FIG. 1A, the inflation needle 106 encloses a conduit 114 that extends through the center of the inflation needle 100 from the second end 104 through the elongated member 106 to the first end 102 to the outlet 110. The conduit 114 provides a pathway for air or other gas to pass through the inflation needle 100 from the second end 104 that is connected to a pump through the elongated member 106 and the first end 102 to exit through the outlet 110 into the inflatable object.

At least a portion of the elongated member 106 includes the flexible portion 108. The flexible portion 108 is a non-rigid, flexible portion of the elongated member 106 that provides a bend point or bending point for the inflation needle. The flexible portion 108 may act like a spring in that a force acting against the flexible portion 108 may cause it to bend in one direction or from side to side without breaking and then return to its straight alignment with the first end 102 and the second end 104 when the force stops acting against it. In this manner, when the inflation needle 100 is inserted into the inflatable object, the inflation needle 100 may bend instead of break if a force is acted upon it. The inflation needle 100 is not so rigid that a force acting on it causes the inflation needle 100 to break but instead merely causes the inflation needle 100 to bend without breaking because of the flexible bellows 108.

In some implementations, as mentioned above, the flexible portion 108 may be implemented as a flexible bellows. The flexible bellows may also compress and/or stretch and then return to its original shape and orientation. The flexible bellows may be flexible corrugated portion that can absorb axial and trans axial forces. The flexible bellows may function in an accordion-like manner. In some implementations, the flexible portion 108 is made of a flexible material, a flexible plastic material, a flexible rubber material, or a combination of materials including, for example, plastic, metal, and/or rubber.

The elongated member 106 also may include a first rigid portion 116 connecting the first end 102 to the flexible portion 108 and a second rigid portion 118 connecting the flexible portion 108 to the second end 104. In some implementations, the first rigid portion 116, the flexible portion 108 and the second rigid portion 118 all may be made from the same material such as, for example, plastic, rubber or metal. In other implementations, the first rigid portion 116, the flexible portion 108 and the second rigid portion 118 may be made from different materials. For example, the first rigid portion 116 and the second rigid portion 118 may be made from one material and the flexible portion 108 may be made from a different material including materials selected from a combination of plastic, metal and/or rubber or other like materials.

The inflation needle 100 also may include an optional stopping member 120. The stopping member is oriented perpendicular to the elongated member 106 to provide a stopping point for insertion into the inflatable object. When the first end 102 is inserted into the inflatable object, the first end 102 only may be inserted to the point where the stopping member 120 meets the surface of the inflatable object. The stopping member 120 may be used to assist both the insertion of the inflation needle 100 into the inflatable object and with the removal of the inflation needle 100 from the inflatable object. The stopping member 120 also may provide a gripping point for a user's fingers to grab the inflation needle 100 for insertion and removal.

In some implementations, the inflation needle 100 is made from metal. In some implementations, the inflation needle 100 is cast-molded as a single piece of material. For example, the inflation needle 100 may be cast-molded as a single piece of metal material.

In some implementations, the inflation needle 100 is made of separate components that are connected together in a manufacturing process such as by welding or soldering or overmolding.

Figure 2A:
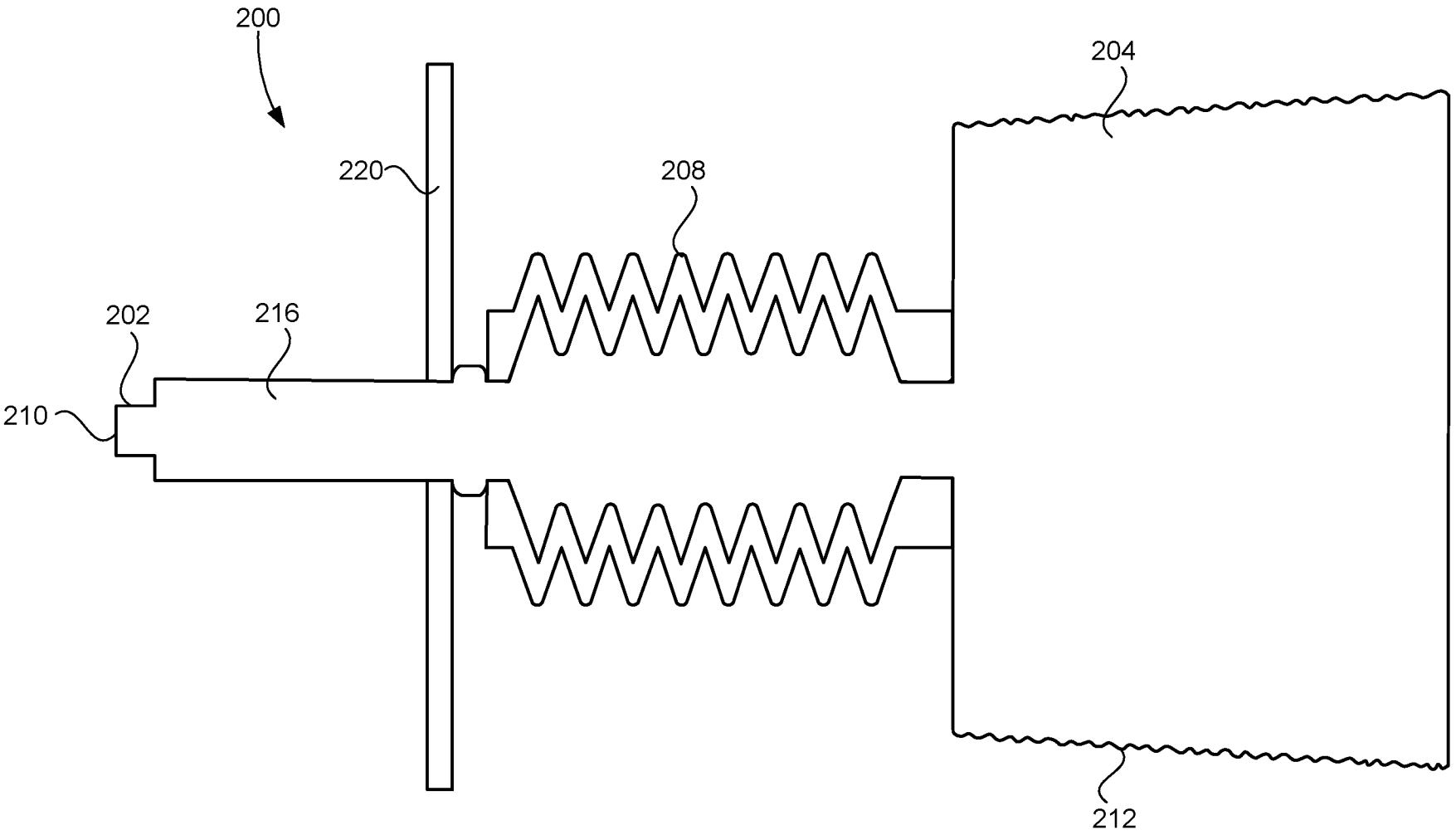
FIG. 2A is a side view of an inflation needle in accordance with a second embodiment.
Figure 2B:
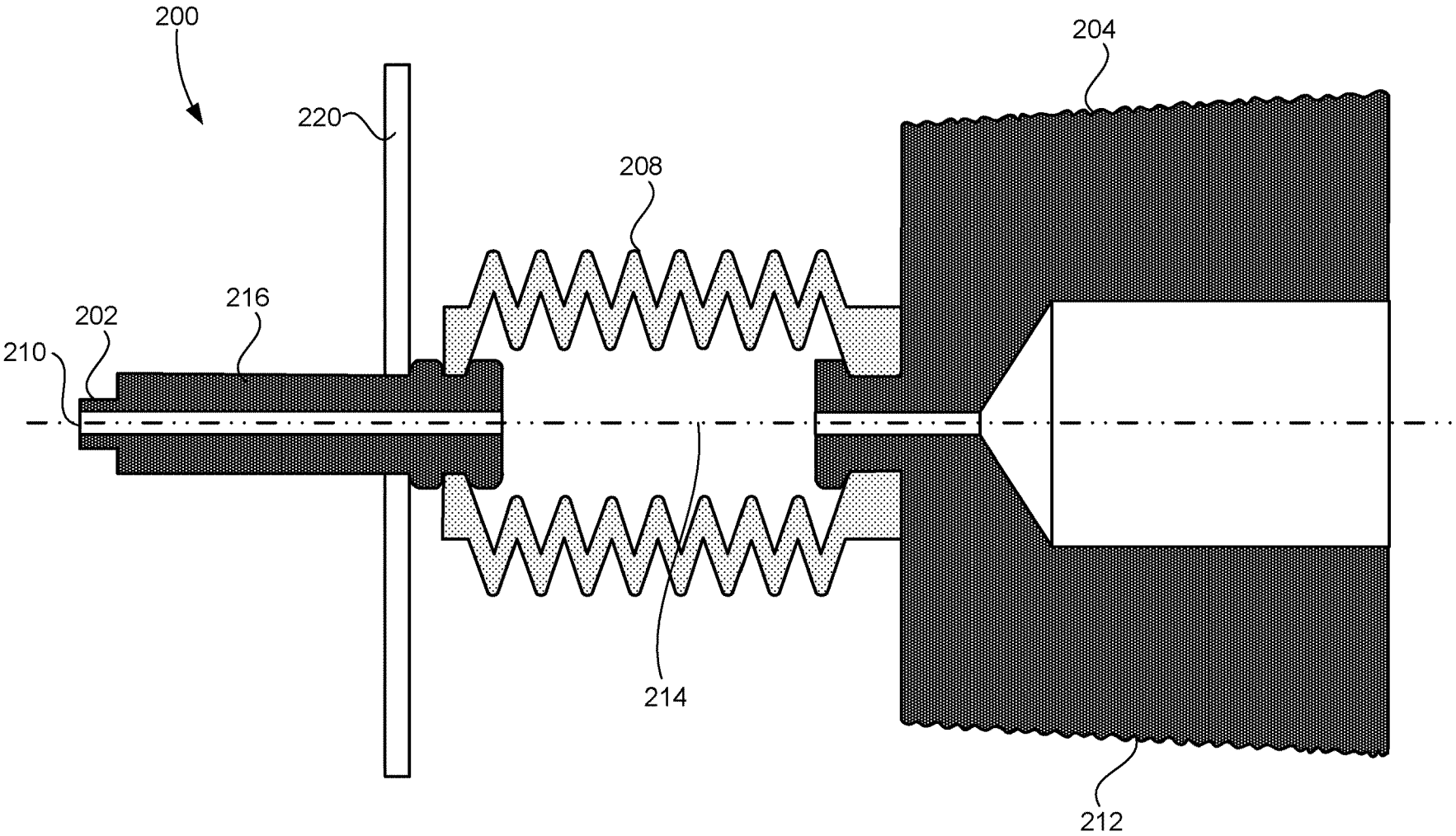
FIG. 2B is a cross section view of the inflation needle of FIG. 2A.

Referring to FIGS. 2A and 2B, an example inflation needle 200 is illustrated. FIG. 2A illustrates a side view of the inflation needle 200 and FIG. 2B illustrates a cross-section of the inflation needle 200 of FIG. 2A. The inflation needle 200 may function similar to the inflation needle 100 of FIGS. 1A and 1B and include some or all of the features and functionality as the inflation needle 100 of FIGS. 1A and 1B.

The inflation needle 200 includes a first end 202 for insertion into the inflatable object and a second end 204 for connection to the pump. The first end 202 and the second end 204 may include all the features and functionality of the first end 102 and the second end 104 of FIGS. 1A and 1B, as described above. For example, the first end 202 may include an outlet 210 similar to the outlet 110 of FIGS. 1A and 1B and the second end 204 may include threads 212 similar to the threads 112 of FIGS. 1A and 1B.

The inflation needle 200 includes a rigid portion 216 that is adjacent to the first end 202 and a flexible portion 208 that connects the rigid portion 216 and the second end 204. The second end 204, the flexible portion 208, the rigid portion 216 and the first end 202 include a conduit 214 through the center of the inflation needle 200, where the conduit 214 includes the features and functions of the conduit 114 of FIG. 1B, as described above.

In the inflation needle 200, a portion of the rigid portion 216 and a portion of the second end 204 extends into the flexible portion 208 to provide a connection points for the flexible bellows 208 to connect, as illustrated in FIG. 2B. The flexible portion 208 includes the features and functionality of the flexible portion 108 of FIGS. 1A and 1B, including being implemented as a flexible bellows or other flexible conduit.

Similarly to the inflation needle 100 of FIGS. 1A and 1B, the inflation needle 200 may include an optional stopping member 220, which functions like the stopping member 120, as described above.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the embodiments.

What is claimed is:

1. An inflation needle, comprising:
- a first end for insertion into an inflatable object;
- a second end for connection to a pump; and
- an elongated member having a conduit for air therethrough and connecting the first and second end, wherein:
  - at least a portion of the elongated member includes a flexible portion, and
  - the first end, the second end, and the elongated member comprise a metal material and a rubber material.

2. The inflation needle of claim 1, wherein the flexible portion comprises a flexible bellows.

3. The inflation needle of claim 1, wherein the flexible portion comprises a flexible metal material.

4. The inflation needle of claim 1, wherein the flexible portion comprises a flexible plastic material.

5. The inflation needle of claim 1, wherein the elongated member further comprises:
- a first rigid portion connecting the first end to the flexible portion; and
- a second rigid portion connecting the flexible portion to the second end.

6. The inflation needle of claim 1, further comprising a stopping member that is oriented perpendicular to the elongated member to provide a stopping point for insertion into the inflatable object.

7. The inflation needle of claim 1, wherein the first end is tapered for insertion into the inflatable object.

8. The inflation needle of claim 1, wherein the second end comprises a threaded portion for connection to the pump.

9. The inflation needle of claim 1, wherein the inflation needle is cast-molded as a single piece of material.

10. An inflation needle, comprising:
- a first end that is tapered for insertion into an inflatable object;
- a second end having a threaded connection for connection to a pump; and
- an elongated member having a conduit for air therethrough and connecting the first end and the second end, wherein the elongated member comprises:
  - a first rigid portion adjacent the first end,
  - a flexible portion, wherein the first rigid portion connects the first end to the flexible portion, and
  - a second rigid portion that connects the flexible portion to the second end,
- wherein the first end, the second end, and the elongated member comprise a metal material and a rubber material.

11. The inflation need of claim 10, wherein the flexible portion comprises a flexible bellows.

12. The inflation needle of claim 10, wherein the flexible portion comprises a flexible metal material.

13. The inflation needle of claim 10, wherein the flexible portion comprises a flexible plastic material.

14. The inflation needle of claim 10, further comprising a stopping member that is oriented perpendicular to the elongated member to provide a stopping point for insertion into the inflatable object.

15. The inflation needle of claim 14, wherein the stopping member is disposed between the flexible portion and the first end.

16. The inflation needle of claim 10, wherein the inflation needle is cast-molded as a single piece of material.

17. An inflation needle, comprising:
- a first end for insertion into an inflatable object;
- a second end for connection to a pump;
- a rigid portion adjacent the first end; and
- a flexible portion connecting the rigid portion and the second end, wherein the second end, the flexible portion, the rigid portion and the first end define a conduit for air therethrough, wherein the first end, the second end, and the flexible portion comprise a metal material and a rubber material.

18. The inflation needle of claim 17, wherein the flexible portion comprises a flexible bellows.

* * * * *